US006551967B2

(12) United States Patent
King et al.

(10) Patent No.: US 6,551,967 B2
(45) **Date of Patent: *Apr. 22, 2003**

(54) LOW OVERBASED ALKYLARYL SULFONATES

(75) Inventors: William Frank King, Novato, CA (US); Curtis Bay Campbell, Hercules, CA (US); Olivier Clement, Le Havre (FR); Jean-Louis Le Coent, Le Havre (FR); Steven Gale Lockett, San Rafael, CA (US); Richard James Nelson, Pinole, CA (US); Pierre Tequi, St. Romain de Colbosc (FR)

(73) Assignee: Chevron Chemical S.A. (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/197,346

(22) Filed: Nov. 20, 1998

(65) Prior Publication Data

US 2001/0034307 A1 Oct. 25, 2001

(51) Int. Cl.[7] ..... C10M 135/10; C07C 309/00
(52) U.S. Cl. ..... 508/391; 562/115
(58) Field of Search ..... 508/391; 562/30, 562/41, 45, 115

(56) References Cited

U.S. PATENT DOCUMENTS

| | | | | |
|---|---|---|---|---|
| 2,794,829 | A | 6/1957 | V der Waarden et al. | 260/505 |
| 4,129,589 | A | 12/1978 | Eliades et al. | 260/504 |
| 4,164,474 | A | 8/1979 | Gallacher et al. | 252/33 |
| 4,235,810 | A | 11/1980 | Osselet et al. | 260/505 |
| 4,259,193 | A | 3/1981 | Tirtiaux et al. | 253/33 |
| 4,387,033 | A | 6/1983 | Lenack et al. | 252/18 |
| 4,764,295 | A | 8/1988 | Le Count | 252/33.2 |
| 5,132,033 | A | 7/1992 | Jao et al. | 252/33 |

FOREIGN PATENT DOCUMENTS

| | | | |
|---|---|---|---|
| EP | 0354621 A1 | 8/1989 | C07C/309/31 |
| EP | 0731072 A1 | 9/1996 | C07C/15/107 |
| GB | 1575957 | 9/1977 | C07C/143/34 |
| WO | 94/05747 | 3/1994 | C10M/159/24 |
| WO | 94/05748 | 3/1994 | C10M/159/24 |
| WO | WO 96/26919 | 6/1996 | C07C/303/32 |
| WO | 98/14280 | 4/1998 | B05D/159/24 |
| WO | WO98/10044 | 12/1998 | C10M/159/24 |

OTHER PUBLICATIONS

Zachary P. Demko and K. Barry Sharpless, "Preparation of 5–Substituted 1*H*–Tetrazoles from Nitriles in Water", *J. Org. Chem* 2001, vol. 66, No. 24, pp. 7945–7950.

*Primary Examiner*—Cephia D. Toomer
(74) *Attorney, Agent, or Firm*—Sarita R. Kelley; Richard J. Sheridan

(57) ABSTRACT

Low overbased alkaline earth metal alkylaryl sulfonate having a Total Base Number of from about 2 to about 30, a dialkylate content of 0% to about 25% and a monoalkylate content of about 75% to about 90% or more, wherein the alkylaryl moiety is alkyltoluene or alkylbenzene in which the alkyl group is a $C_{15}$–$C_{21}$ branched chain alkyl group derived from a propylene oligomer are useful as lubricating oil additives.

2 Claims, No Drawings

LOW OVERBASED ALKYLARYL SULFONATES

BACKGROUND OF THE INVENTION

Sulfonates, particularly calcium, barium or magnesium overbased sulfonates are widely used as additives for lubricating oils. The term "overbased" is used to describe sulfonates containing an amount of metal in excess of that required to react with the sulfonic acid from which the sulfonate is obtained. Frequently, the excess metal is in the form of its carbonate, in which case the overbased sulfonate consists of a colloidal dispersion of the metal carbonate in the metal sulfonate as dispersant. These overbased sulfonates are used as dispersants in the lubricating oil where their basicity neutralizes acids which develop in the crank cases of engines during engine operation, thus reducing corrosion.

Sulfonates are generally obtained from monoalkylates of aromatics, the alkyl chain being either branched or straight. Oil soluble sulfonates are obtained from alkylates containing an alkyl group of more than 16, generally more than 20, carbon atoms.

WO 96/26919 discloses low base number sulfonates which are said to be useful in lubricants. The sulfonates are prepared from high molecular weight sulfonic acids (i.e., they have a number average molecular weight of 500 or higher). The high molecular weight sulfonic acids may be alkaryl sulfonic acids, for example alkyl benzene sulfonic acid, alkyl toluene sulfonic acid or alkylxylene sulfonic acid. It is preferred that the sulfonic acid is a mixed sulfonic acid of $C_{15}$ to $C_{60}$ and higher alkyl benzene or $C_{15}$ to $C_{60}$ and higher alkyl xylene or $C_{15}$ to $C_{60}$ and higher alkyl toluene sulfonic acids.

A lower molecular weight sulfonic acid may also be used. It is preferably an alkylaryl sulfonic acid and most preferably a mixture of $C_8$ to $C_{30}$ and higher alkyl substituted alkyl benzene or alkyl toluene or alkyl xylene sulfonic acid. It is preferred that the lower molecular weight sulfonic acid has a number average molecular weight of at least 300, preferably at least 350.

The preferred high molecular weight sulfonic acids and when present lower molecular weight sulfonic acids are said to be those which are derived from aromatic alkylates prepared from $C_2$, $C_3$ or $C_4$ polyolefins such as polyethylene, polypropylene or polynormal butene. It is also said to be possible to prepare straight chain lower molecular weight sulfonic acids from aromatic alkylates prepared from straight chain hydrocarbons such as linear alpha-olefins.

U.S. Pat. No. 4,235,810, issued Nov. 25, 1980 to Osselet et al., discloses alkyl aromatics prepared by alkylation with a mixture of straight and branched chain olefins containing 16 to 30 carbon atoms. Oligomers of propylene are said to be the preferred branched chain olefin. The alkyl aromatics can be converted to sulfonates having a Total Base Number of 300.

U.S. Pat. No. 4,259,193, issued Mar. 31, 1981 to Tirtiaux et al., discloses overbased alkaline earth metal mono-alkyl ortho-xylene in which the alkylaryl moiety is a mono-alkyl ortho-xylene or a mono-alkyl toluene and the alkyl group contains 15 to 40 carbon atoms. The alkyl group may be straight chain or branched. Oligomers of propylene may be used for the alkyl group. In the examples, the overbased sulfonates have a Total Base Number of 300.

U.S. Pat. No. 4,387,033, issued Jun. 7, 1983 to Lenack et al., discloses highly basic calcium sulfonates having a Total Base Number of 400. The alkyl sulfonic acid used to prepared the sulfonate should preferably have at least 18 carbon atoms in the alkyl chain. Alkaryl sulfonic acids having a molecular weight of between 300 and 700, e.g., between 400 and 500, such as alkyl benzene and alkyl toluene sulfonic acids are said to be suitable. The alkyl group may be straight chain or branched.

SUMMARY OF THE INVENTION

In accordance with the present invention, there is provided a low overbased alkaline earth metal alkylaryl sulfonate having a Total Base Number of from about 2 to about 30, a dialkylate content of 0% to about 25% and a monoalkylate content of about 75% to about 90% or more, wherein the alkylaryl moiety is alkyltoluene or alkylbenzene in which the alkyl group is a $C_{15}$–$C_{21}$ branched chain alkyl group derived from a propylene oligomer.

The present invention also provides a lubricating oil containing a low overbased alkaline earth metal alkylaryl sulfonate having a Total Base Number of from about 2 to about 30, a dialkylate content of 0% to about 25% and a monoalkylate content of about 75% to about 90% or more, wherein the alkylaryl moiety is alkyltoluene or alkylbenzene in which the alkyl group is a $C_{15}$–$C_{21}$ branched chain alkyl group derived from a propylene oligomer.

Also provided by the present invention is a lubricating oil formulation comprising:

(a) a major amount of a base oil of lubricating viscosity;

(b) about from 1 to 20 weight % of at least one ashless dispersant;

(c) from 1 to 40 weight % of a low overbased alkaline earth metal alkylaryl sulfonate having a Total Base Number of from about 2 to about 30, a dialkylate content of 0% to about 25% and a monoalkylate content of about 75% to about 100%, wherein the alkylaryl moiety is alkyltoluene or alkylbenzene in which the alkyl group is a $C_{15}$–$C_{21}$ branched chain alkyl group derived from a propylene oligomer;

(d) about from 0.05 to 5 weight % of at least one zinc dithiophosphate;

(e) from 0 to 10 weight % of at least one oxidation inhibitor;

(f) from 0 to 1 weight % of at least one foam inhibitor; and (g) from 0 to 20 weight % of at least one viscosity index improver.

The present invention further provides a concentrate comprising about from 10 weight % to 90 weight % of a compatible organic liquid diluent and about from 0.5 weight % to 90 weight % of a low overbased alkaline earth metal alkylaryl sulfonate having a Total Base Number of from about 2 to about 30, a dialkylate content of 0% to about 25% and a monoalkylate content of about 75% to about 100%, wherein the alkylaryl moiety is alkyltoluene or alkylbenzene in which the alkyl group is a $C_{15}$–$C_{21}$ branched chain alkyl group derived from a propylene oligomer.

Further provided in accordance with the present invention is a method of producing a lubricating oil composition comprising blending the following components together:

(a) a major amount of a base oil of lubricating viscosity;

(b) from 1 to 20 weight % of at least one ashless dispersant;

(c) from 5 to 20 weight % of a low overbased alkaline earth metal alkylaryl sulfonate having a Total Base Number of from about 2 to about 30, a dialkylate content of 0% to about 25% and a monoalkylate content of about 75% to about 100%, wherein the alkylaryl moiety is alkyltoluene or alkylbenzene in which the alkyl group is a $C_{15}$–$C_{21}$ branched chain alkyl group derived from a propylene oligomer;

(d) from 0.05 to 5 weight % of at least one zinc dithiophosphate;

(e) from 0 to 10 weight % of at least one oxidation inhibitor;

(f) from 0 to 1 weight % of at least one foam inhibitor; and (g) from 0 to 20 weight % of at least one viscosity index improver.

The present invention also provides the lubricating oil composition produced by this method.

The present invention also provides an improved method of preparing an alkaline earth metal alkyltoluene sulfonate by reacting an alkyltoluene sulfonic acid with an active source of alkaline earth metal in the presence of a solvent, wherein the improvement comprises using water as the solvent.

DETAILED DESCRIPTION OF THE INVENTION

The low overbased alkylaryl sulfonates of the present invention are prepared from alkylates of benzene and toluene. The alkylates may be prepared by Friedel-Crafts alkylation of the benzene or toluene using techniques known in the art.

The alkylates used to prepare the sulfonates of this invention are prepared using a propylene oligomer for the alkyl group. The propylene oligomers useful for this purpose have an average of about 15 to 21, preferably about 14 to 18, carbon atoms. The oligomers have a low di-olefin content, i.e., they have a Bromine Number of about 15 to about 25 mg/100 g.

The synthesis of the alkyltoluene alkylate can be accomplished by the alkylation of toluene with the propylene oligomer described below using a variety of Lewis or Bronsted acid catalysts. Typical commercial catalysts include, but are not limited to, phosphoric acid/kieselguhr, aluminum halides, boron trifluoride, antimony chloride, stannis chloride, zinc chloride, onium poly(hydrogen fluoride), and hydrogen fluoride. Other catalysts include solid acidic catalysts that have at least one metal oxide, such as natural zeolites, synthetic zeolites, synthetic molecular sieves, and clays.

The alkylation of toluene can produce a variety of products. These include, but are not limited to, isomeric monoalkylated toluenes, such as ortho-alkyltoluene, meta-alkyltoluene, and para-alkyltoluene. Other products can include di-alkylated and/or polyalkylated toluene products and their isomers. The preferred toluene alkylate is one which affords acceptable sulfonation yields.

GLPC analysis of the preferred alkylated toluene product reveals that it is composed of three major fractions which are referred to herein as Light Product, Heartcut Product, and Heavies Product. GLPC analysis of the toluene alkylate is accomplished using a Varian 6100 gas chromatograph equipped with an FID detector operating with the following column and instrument conditions:

1 Microliter on-column injection 15 m×1.5 micron J&W DB-5 Megabore

Injector temperture 250° C.

Detector temperature 300° C.

Helium carrier gas

Temperature program:

Hold at 75° C. for 5 minutes

75–150° C. at 7.5 deg./minute

150–250° C. at 5.0 deg./minute

250–290° C. at 2.0 deg/minute

Hold at 290° C. for 25 minutes

The resulting chromatogram is analyzed in the following manner to determine the percentage of Light, Heartcut, and Heavies distribution:

Percent Light Product content=Area of peaks eluting between 15.05 and 30 minutes/Area of peaks eluting between 15.05 and 80 minutes Percent Heartcut Product content=Area of peaks eluting between 30.05 and 45 minutes/Area of peaks eluting between 15.05 and 80 minutes Percent Heavies Product content=Area of peaks eluting between 45.05 and 80 minutes/Area of peaks eluting between 15.05 and 80 minutes The preferred toluene alkylates of this invention contain about 0–15% Light Product, about 75–90% Heartcut Product, and about 0–15% Heavies Product.

The toluene alkylate can also be analyzed by IR by recording the absorbance IR spectrum of the product as a film on salt block cells. The IR spectrum is scaled to the 650–1000 $cm^{-1}$ region and plotted. The isomer distribution is calculated as follows:

Percent ortho isomer content=Height of peak at 705 $cm^{-1}$/Sum of the peak heights at 705 $cm^{-1}$, 785 $cm^{-1}$, and 815 $cm^{-1}$ Percent meta isomer content=Height of peak at 785 $cm^{-1}$/Sum of the peak heights at 705 $cm^{-1}$, 785 $cm^{-1}$, and 815 $cm^{-1}$ Percent para isomer content=Height of peak at 815 $cm^{-1}$/Sum of the peak heights at 705 $cm^{-1}$, 785 $cm^{-1}$, and 815 $cm^{-1}$ The preferred toluene alkylate of this invention has an isomer distribution of about 25–35% ortho isomer, about 15–25% meta isomer and about 40–55% para isomer.

The alkylated benzene and toluene used to prepare the sulfonates of this invention have a molecular weight of about 300 to about 315, preferably about 300 to about 308. They may comprise mixtures of monoalkylates and dialkylates. As used herein, the term "monoalkylate" refers to the fact that the alkylate contains only one alkyl group derived from the propylene oligomers, and "dialkylate" refers to compounds which have two alkyl groups derived from the propylene oligomers. Neither of these terms is intended to refer to any other alkyl groups which may be on the aromatic ring, such as the methyl group in toluene.

The alkylates used to prepare the sulfonates of this invention are preferably all monoalkylates. However, mixtures of monoalkylates and dialkylates may be used. When such mixtures are employed they generally contain about 75%, preferably about 85%, and more preferably about 90% to 100% monoalkylates, the balance, if any, being dialkylates.

Since the alkylates are prepared from oligomers of propylene, the alkyl group on the aromatic ring will all be branched chain alkyls. The alkylates of this invention do not contain linear alkyl groups.

In a preferred embodiment of this invention, the alkylate is a mixture of ortho-, meta- and para-isomers of alkyltoluene. Preferably, the mixture contains about 25–35% ortho-isomer, about 15–25% meta-isomer and about 40–55% para-isomer.

The alkylates are sulfonated, and the sulfonic acid neutralized with an alkaline earth metal using methods known in the art.

The sulfonates of this invention are overbased, i.e., they contain more alkaline earth metal than is needed to neutralize the sulfonic acid. They are considered low overbased materials since they have a relatively low Total Base Number ("TBN"). As used herein, "Total Base Number" refers to the amount of base equivalent to one milligram of KOH in one gram of additive. Thus, higher TBN numbers reflect more alkaline products and therefore a greater alkalinity reserve. The Total Base Number for an additive composition is readily determined by ASTM test method D664 or other equivalent methods. The low overbased alkylaryl sulfonates of this invention have Total Base Numbers from about 2 to about 30.

The alkaline earth metal used to form the sulfonates may be calcium, barium or magnesium, with calcium being preferred.

It has been discovered that when the alkyltoluene sulfonate is the desired product, the overbasing reaction can be conducted using water as the solvent. Previously, a combination of water and an organic solvent, such as 2-ethylhexanol, was employed. However, use of an organic solvent is more expensive than when water is the only solvent, and also leads to waste disposal problems. It has now been found that the reaction can be conducted using only water as the solvent, i.e., in the absence of an organic solvent. Often, the overbasing reaction is conducted in the presence of lubricating oil. For purposes of this disclosure, such oils are not considered solvents for the overbasing reaction.

The present invention provides a lubricating oil composition containing the low overbased alkaline earth alkylaryl sulfonates of this invention. It is possible for the lubricating oil composition to also contain sulfonates other than those of this invention, such as sulfonates in which the alkyl group in the alkylaryl moiety is linear. However, in the lubricating oil compositions and concentrates of this invention, more than 50% of the alkyl groups in the alkylaryl moiety are branched chain alkyls. Preferably, more than about 60–65% of the alkyls are branched, and still more preferably, essentially all (i.e. 95–100%) of the alkyls are branched.

In one embodiment, the lubricating oil also has an ashless dispersant and a zinc dialkyldithiophosphate. In another embodiment, the lubricating oil also has a detergent selected from the group consisting of metal phenates, metal sulfonates, and metal salicylates. Other additives which may be present in the formulation include rust inhibitors, foam inhibitors, corrosion inhibitors, metal deactivators, pour point depressants, anti-oxidants, and a variety of other well-known additives More specifically, the following additive components exemplify the components that can be favorably employed in combination with the overbased, alkylbenzene or alkyltoluene sulfonates of the present invention (1) Metallic detergents: overbased sulfurized alkylphenates, overbased sulfonates, and overbased salicylates.

(2) Ashless dispersants: alkenyl succinimides, alkenyl succinimides modified with other organic compounds, and alkenyl succinimides modified with boric acid, alkenyl succinic ester.

(3) Oxidation inhibitors

1) Phenol type phenolic) oxidation inhibitors: 4,4'-methylenebis (2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N, N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl-4-hydroxybenzyl).

2) Diphenylamine type oxidation inhibitor: alkylated diphenylamine, phenyl-I-naphthylamine, and alkylated I-naphthylamine.

3) Other types: metal dithiocarbamate (e.g., zinc dithiocarbamate), and methylenebis (dibutyldithiocarbamate).

(4) Rust inhibitors (Anti-rust agents)

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate.

2) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(5) Demulsifiers: addition product of alkylphenol and ethyleneoxide, poloxyethylene alkyl ether, and polyoxyethylene sorbitane ester.

(6) Extreme pressure agents (EP agents): zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(7) Friction modifiers: fatty alcohol, fatty acid, amine, borated ester, and other esters (8) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenum complex compound (9) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(10) Pour point depressants: polymethyl methacrylate

The low overbased sulfonates of this invention are useful for imparting detergency and dispersancy properties to the lubricating oil. They provide lubricating compositions that have good coefficients of friction, are compatible with other additives, particularly sulfonates and phenates, do not cause the lubricating composition to skin, have good water tolerance, do not cause foaming, have good oxidative stability, and afford good rust protection.

When employed in lubicants, the amount of the alkylbenzene or alkyltoluene sulfonates of alkaline earth metals ranges from about 0.5% to 40% of the total lubricant composition, although preferably from about 1% to 25% of the total lubricant composition. Such lubricating oil compositions are useful in the crankcase of an internal combustion engine, such as gasoline engines and diesel engines, including passenger car, heavy duty on-road and off-road, railroad, natural gas and marine, such as trunk piston and slow speed crosshead. They are also useful in hydraulic applications.

The lubricating oil composition can be used in a method of decreasing black sludge deposits, a method of decreasing piston deposits, or both.

Such lubricating oil compositions employ a finished lubricating oil, which may be single or multigrade. Multigrade lubricating oils are prepared by adding viscosity index (VI) improvers. Typical VI improvers are polyalkyl methacrylates, ethylene-propylene copolymers, styrene-diene copolymers, and the like. So-called dispersant VI improvers, which exhibit dispersant properties as well as VI modifying properties, can also be used in such formulations.

The oil of lubricating viscosity used in such compositions may be mineral oil or synthetic oils of viscosity suitable for use in the crankcase of an internal combustion engine, such as gasoline engines and diesel engines, including passenger car, heavy duty on-road and off-road, railroad, natural gas and marine, such as trunk piston and slow speed crosshead. Crankcase lubricating oils ordinarily have a viscosity of about 1300 cSt 0° F. to 24 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of both monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acids and mono and dihydroxy alkanols can also be used.

Blends of mineral oils with synthetic oils are also useful. For example, blends of 10% to 25% hydrogenated 1-trimer with 75% to 90% 150 SUS (100° F.) mineral oil gives an excellent lubricating oil base.

In one embodiment, a lubricating oil composition would contain (a) a major amount of an oil of lubricating viscosity;

(b) from 1% to 20% of at least one ashless dispersant;

(c) from 1% to 40% of the mixture of alkyl aryl sulfonates of alkaline earth metals of the present invention;

(d) from 0.05% to 5% of at least one zinc dithiophosphate;

(e) from 0.0% to 10% of at least one oxidation inhibitor;

(f) from 0.0% to 1% of at least one foam inhibitor; and (g) from 0.0% to 20% of at least one viscosity index improver.

Additive concentrates are also included within the scope of this invention. The concentrates of this invention comprise the alkylbenzene or alkyltoluene sulfonates of alkaline earth metals of the present invention, with at least one of the additives disclosed above. Typically, the concentrates contain sufficient organic diluent to make them easy to handle during shipping and storage.

From 10% to 90% of the concentrate is organic diluent. From 0.5% to 90% of concentrate is the alkylbenzene or alkyltoluene sulfonates of alkaline earth metals of the present invention. The remainder of the concentrate consists of other additives.

Suitable organic diluents which can be used include for example, solvent refined 100N, i.e., Cit-Con 100N, and hydrotreated 100N, i.e., RLOP 100N, and the like. The organic diluent preferably has a viscosity of from about 1 to about 20 cSt at 100° C.

Below are representative examples of additive packages that can be used in a variety of applications. These representative examples employ the alkylbenzene or alkyltoluene sulfonates of alkaline earth metals of the present invention (listed simply as "Sulfonate"). The following weight percents are based on the amount of active component, with neither process oil nor diluent oil. These examples are provided to illustrate the present invention, but they are not intended to limit it.

| | |
|---|---|
| I. Marine Diesel Engine Oils | |
| 1) Sulfonate | 65% |
| Primary alkyl Zn-DTP | 5% |
| Oil of lubricating viscosity | 30% |
| 2) Sulfonate | 65% |
| Alkenyl succinimide ashless dispersant | 5% |
| Oil of lubricating viscosity | 30% |
| 3) Sulfonate | 60% |
| Primary alkyl Zn-DTP | 5% |
| Alkenyl succinimide ashless dispersant | 5% |
| Oil of lubricating viscosity | 30% |
| 4) Sulfonate | 65% |
| Phenol type oxidation inhibitor | 10% |
| Oil of lubricating viscosity | 25% |
| 5) Sulfonate | 55% |
| Alkylated diphenylamine-type oxidation inhibitor | 15% |
| Oil of lubricating viscosity | 30% |
| 6) Sulfonate | 65% |
| Phenol-type oxidation inhibitor | 5% |
| Alkylated diphenylamine-type oxidation inhibitor | 5% |
| Oil of lubricating viscosity | 25% |
| 7) Sulfonate | 60% |
| Primary alkyl Zn-DTP | 5% |
| Phenol-type oxidation inhibitor | 5% |
| Oil of lubricating viscosity | 30% |
| 8) Sulfonate | 60% |
| Alkenyl succinimide ashless dispersant | 5% |
| Alkylated diphenylamine-type oxidation inhibitor | 10% |
| Oil of lubricating viscosity | 25% |
| 9) Sulfonate | 55% |
| Other additives | 25% |
| Primary alkyl Zn-DTP | |
| Alkenyl succinic ester ashless dispersant | |
| Phenol-type oxidation inhibitor | |
| Alkylated diphenylamine-type oxidation inhibitor | |
| Oil of lubricating viscosity | 30% |
| II. Motor Car Engine Oils | |
| 1) Sulfonate | 25% |
| Alkenyl succinimide ashless dispersant | 35% |
| Primary alkyl Zn-DTP | 10% |
| Oil of lubricating viscosity | 30% |
| 2) Sulfonate | 20% |
| Alkenyl succinimide ashless dispersant | 40% |
| Secondary alkyl Zn-DTP | 5% |
| Dithiocarbamate type oxidation inhibitor | 5% |
| Oil of lubricating viscosity | 30% |
| 3) Sulfonate | 20% |
| Alkenyl succinimide ashless dispersant | 35% |
| Secondary alkyl Zn-DTP | 5% |
| Phenol type oxidation inhibitor | 5% |
| Oil of lubricating viscosity | 35% |

-continued

| | |
|---|---|
| 4) Sulfonate | 20% |
| Alkenyl succinimide ashless dispersant | 30% |
| Secondary alkyl Zn-DTP | 5% |
| Dithiocarbamate type anti-wear agent | 5% |
| Oil of lubricating viscosity | 40% |
| 5) Sulfonate | 20% |
| Succinimide ashless dispersant | 30% |
| Secondary alkyl Zn-DTP | 5% |
| Molybdenum-containing anti-wear agent | 5% |
| Oil of lubricating viscosity | 40% |
| 6) Sulfonate | 20% |
| Alkenyl succinimide ashless dispersant | 30% |
| Other additives | 10% |
| Primary alkyl Zn-DTP | |
| Secondary alkyl Zn-DTP | |
| Alkylated diphenylamine-type oxidation inhibitor | |
| Dithiocarbamate type anti-wear agent | |
| Oil of lubricating viscosity | 40% |
| 7) Sulfonate | 60% |
| Other additives | 10% |
| Phenol type oxidation inhibitor | |
| Alkylated diphenylamine-type oxidation inhibitor | |
| Dithiocarbamate type anti-wear agent | |
| Demulsifier | |
| Boron-containing friction modifier | |
| Oil of lubricating viscosity | 30% |
| III. Hydraulic Oils | |
| 1) Sulfonate | 20% |
| Primary alkyl Zn-DTP | 50% |
| Other addtives | 25% |
| Phenol type oxidation inhibitor | |
| Phosphorous-containing extreme pressure agent | |
| Triazol type corrosion inhibitor | |
| Demulsifier | |
| Nonionic anti-rust agent | |
| Oil of lubricating viscosity | 5% |
| 2) Sulfonate | 10% |
| Primary alkyl Zn-DTP | 40% |
| Other addtives | 47% |
| Phenol type oxidation inhibitor | |
| Sulfur-containing extreme pressure agent | |
| Triazol type corrosion inhibitor | |
| Demulsifier | |
| Nonionic anti-rust agent | |
| Oil of lubricating viscosity | 3% |
| 3) Sulfonate | 10% |
| Phosphorous-containing extreme pressure agent | 40% |
| Phenol type oxidation inhibitor | 15% |
| Other addtives | 25% |
| Diphenylamine type oxidation inhibitor | |
| Sulfur-containing extreme pressure agent | |
| Triazol type corrosion inhibitor | |
| Demulsifier | |
| Nonionic anti-rust agent | |
| Oil of lubricating viscosity | 10% |
| 4) Sulfonate | 20% |
| Phosphorous-containing extreme pressure agent | 30% |
| Other addtives | 45% |
| Diphenylamine type oxidation inhibitor | |
| Sulfur-containing extreme pressure agent | |
| Triazol type corrosion inhibitor | |
| Demulsifier | |
| Nonionic anti-rust agent | |
| Oil of lubricating viscosity | 5% |
| IV. Transmission Hydraulic Fluids | |
| 1) Sulfonate | 35% |
| Primary alkyl Zn-DTP | 20% |
| Polyol type friction modifier | 20% |
| Sulfur-containing extreme pressure agent | 5% |
| Oil of lubricating viscosity | 20% |
| 2) Sulfonate | 40% |
| Primary alkyl Zn-DTP | 15% |
| Amide type friction modifier | 15% |
| Sulfur-containing extreme pressure agent | 5% |
| Oil of lubricating viscosity | 25% |

-continued

| | |
|---|---|
| 3) Sulfonate | 30% |
| Primary alkyl Zn-DTP | 20% |
| Other addtives | 30% |
| Alkenyl succinimide ashless dispersant | |
| Amide type friction modifier | |
| Ester type friction modifier | |
| Phosphorous, Sulfur-containing extreme pressure agent | |
| Oil of lubricating viscosity | 20% |
| 4) Sulfonate | 35% |
| Primary alkyl Zn-DTP | 15% |
| Other addtives | 25% |
| Polyol type friction modifier | |
| Amide type friction modifier | |
| Phosphorous, Sulfur-containing extreme pressure agent | |
| Oil of lubricating viscosity | 25% |

In one embodiment, a lubricating oil composition is produced by blending a mixture of:

(a) a major portion of an oil of lubricating viscosity, (b) from 1% to 40% of sulfonates of this invention, (c) from 0.05% to 5% of a zinc dialkyldithiophosphate, and (d) from 1% to 25% of an alkenyl succinimide ashless dispersant.

The lubricating oil composition produced by that method might have a slightly different composition than the initial mixture, because the components may interact. The components can be blended in any order and can be blended as combinations of components.

The invention will be further illustrated by following examples, which set forth particularly advantageous embodiments. While the Examples are provided to illustrate the present invention, they are not intended to limit it.

EXAMPLE 1

Synthesis of Benzene Alkylate

An alkylbenzene is prepared using a benzene:olefin molar ratio of 4:1. In a stirred vessel, 40.88 ml/minute of a propylene oligomer having an average molecular weight of 220, 56.93 ml/minute of benzene, and 102.19 mil/minute of hydrofluoric acid are added. The residence time in the vessel is 5.75 minutes at 38° C.

The resulting product is placed in a settler where the HF (lower phase) is separated from the organic phase (alkylate and benzene). The organic phase is removed and the benzene is eliminated by stripping. Lower molecular weight alkylate (i.e., alkylate having an alkyl group of 13 or fewer carbon atoms) is removed by distillation.

Gas chromatography indicates that the alkylate product after stripping the benzene contains:

| | |
|---|---|
| Alkylbenzene ($C_4$–$C_{12}$ alkyl) | 33.4% |
| Alkylbenzene ($C_{13}$ alkyl) | 8.6% |
| Alkylbenzene (alkyl higher than $C_{13}$) | 58.0% |

The alkylate product has a Bromine Number of 13 mg/100 grams.

After distillation, the final alkylate product has the following properties:

| | |
|---|---|
| Alkylbenzene ($C_{13}$ alkyl) | 4% |
| Alkylbenzene (alkyl higher than $C_{13}$) | 96% |
| Bromine Number | 30 |
| Molecular weight | 302 |
| Viscosity @40° C. | 18.5 cSt |
| Distillation (ASTM D86) | |
| 5% | 321° C. |
| 95% | 376.8° C. |
| Level of monoalkylbenzene (by IR) | 87% |

EXAMPLE 2

Synthesis of Alkylbenzene Sulfonic Acid

The reaction is conducted in a sulfur trioxide falling film (height of the tube is 2 m.). Sulfur trioxide and the alkylbenzene product from Example 1 are introduced at the top of the tube. Alkylbenzene sulfonic acid is obtained at the bottom. The level of conversion is about 88%, and the mineral acidity (expressed as sulfuric acid) is about 0.6%. The acidity can be decreased by known methods.

EXAMPLE 3

Synthesis of Low Overbased Alkylbenzene Sulfonate

Hydrated lime (65.7 g), diluent oil (638.8 g) and a foam inhibitor (0.2 g) are placed in a suitable vessel, agitated and heated to 60° C. The alkylbenzene sulfonic acid prepared in Example 2 (549.1 g) is added to the vessel over a period of one hour. During this time, the temperature is increased from 60° C. to 85° C. 2-Ethylhexanol (100.7 g), calcium chloride (13.4 g), water (23 g) and a mixture of formic acid/acetic acid (9.1 g, 50/50 by weight) are added to the vessel. The temperature is raised to 100° C. within a period of 25 minutes, and the temperature is maintained at that level for 1.5 hours. The temperature is then raised to 120° C. over a period of one hour, and maintained at that level for one hour. The water and alcohol are removed from the resulting product by distillation under vacuum (4000 Pa) at 195° C. for one hour. The remaining product is filtered to remove solids from the product.

The resulting filtered product has the following properties:

| | |
|---|---|
| % Sediment | 0.01 |
| % Total Ca (wt %) | 2.63 |
| % S (wt %) | 3.21 |
| Viscosity at 100° C. (cSt) | 20 |
| Total Base Number (ASTM D2896) | 23 |
| % Ca as calcium sulfonate | 1.71% |

EXAMPLE 4

Synthesis of Toluene Alkylate

To a two liter autoclave reactor is charged 1,106 grams of toluene, 330 grams of the propylene oligomer of this invention, and 300 grams of Filtrol Grade 24 clay catalyst (Engelhard Corporation). The reactor is sealed and heated to 100° C. with agitation. After approximately 24 hours, the reactor is cooled to room temperature, and the catalyst is removed by filtering the crude product through a sintered glass Buchner funnel with the aid of vacuum. Analysis of this crude product by supercritical fluid chromatography indicates 97.5% conversion of the propylene oligomer to product. The crude product is then fractionally distilled to remove the excess toluene at atmospheric pressure by slowly increasing the distillation pot temperature from room temperature to 140° C. The resulting product in the distillation pot (2015 grams) is then fractionally distilled by gradually increasing the temperature of the distillation pot from approximately room temperature to 196° C. under reduced pressure (3.5 mm Hg) to afford four fractions:

| | |
|---|---|
| Fraction 1 | 76 grams |
| Fraction 2 | 268 grams |
| Fraction 3 | 601 grams |
| Fraction 4 (material left in distillation pot) | 1070 grams |
| Analysis of Fraction 4 shows the following properties: | |
| Viscosity (40° C.) | 30.89 cSt |
| Molecular weight (VPO) | 323 |
| Flash point (COC) | 190° C. |
| Bromine index | 10.4 mg bromine/100 gm sample |
| GLPC analysis of Fraction 4 shows it contains: | |
| Light Product | 0.005% |
| Heartcut Product | 76.7% |
| Heavies Product | 23.3% |
| Analysis by infrared shows the following percent isomer distribution: | |
| Ortho | 17.0% |
| Meta | 13.8% |
| Para | 69.2% |

EXAMPLE 5

Synthesis of Low Overbased Alkyltoluene Sulfonate

A toluene alkylate similar to that of Example 4 is sulfonated and the resulting alkyltoluene sulfonic acid (427 gms.), along with 573 gms. Exxon 100N oil are charged to a reaction vessel and stirred for 15 minutes. The resulting mixture is heated to 100° F. (37.8° C.) and 56.6 gms. $Ca(OH)_2$ is added. Heating to 190° F. (87.8° C.) is begun. The mixture is overheated to 216° F. (102.2° C.), so it is cooled to 192° F. (88.9° C.). One drop of foam inhibitor, 56.5 gms. Water, and 15.1 gms. of a 32% solution of $CaCl_2$ solution is added to the vessel and the temperature drops to 182° F. (83.3° C.). The reaction mixture is heated to 220° F. (104.4° C.) and held between 221° F. (105° C.) and 226° F. (107.8° C.) for 30 minutes. The reaction mixture is then heated to 265° F. (129.4° C.) over 20 minutes, and then to 320° F. (160° C.), with a 40 mm Hg vacuum being applied at 280° F. (137.8° C.). The resulting overbased alkyltoluene sulfonate has a Total Base Number of 23.5.

While the present invention has been described with reference to specific embodiments, this application is intended to cover those various changes and substitutions that may be made by those skilled in the art without departing from the spirit and scope of the appended claims.

What is claimed is:

1. A method of preparing a low overbased alkaline earth metal alkyltoluene sulfonate by reacting an alkyltoluene sulfonic acid with an active source of alkaline earth metal in the presence of solvent wherein the solvent does not comprise an organic solvent.

2. The method of claim 1 wherein the solvent comprises water.

* * * * *